US008752631B2

(12) United States Patent
Stewart

(10) Patent No.: US 8,752,631 B2
(45) Date of Patent: Jun. 17, 2014

(54) ANNULAR CIRCULATION VALVE AND METHODS OF USING SAME

(75) Inventor: Alex C. Stewart, Ellon (GB)

(73) Assignee: Baker Hughes Incorporated, Houston, TX (US)

( * ) Notice: Subject to any disclaimer, the term of this patent is extended or adjusted under 35 U.S.C. 154(b) by 431 days.

(21) Appl. No.: 13/082,214

(22) Filed: Apr. 7, 2011

(65) Prior Publication Data

US 2012/0255741 A1 Oct. 11, 2012

(51) Int. Cl.
*E21B 34/10* (2006.01)

(52) U.S. Cl.
USPC ..... 166/332.1; 166/373

(58) Field of Classification Search
USPC ..... 166/373, 324, 332.1, 321
See application file for complete search history.

(56) References Cited

U.S. PATENT DOCUMENTS

| | | | | |
|---|---|---|---|---|
| 3,527,297 | A | 9/1970 | Todd | |
| 3,633,671 | A | 1/1972 | Nelson | |
| 4,260,017 | A | 4/1981 | Nelson et al. | |
| 4,729,430 | A | 3/1988 | White et al. | |
| 4,936,383 | A | 6/1990 | Towner et al. | |
| 5,020,600 | A | 6/1991 | Coronado | |
| 5,024,273 | A | 6/1991 | Coone et al. | |
| 5,048,611 | A | 9/1991 | Cochran | |
| 5,174,379 | A | 12/1992 | Whiteley et al. | |
| 5,860,452 | A | 1/1999 | Ellis | |
| 6,092,611 | A | 7/2000 | Saxman | |
| 6,095,248 | A * | 8/2000 | Freeman | 166/313 |
| 6,109,356 | A | 8/2000 | Echols et al. | |
| 6,155,342 | A | 12/2000 | Oneal et al. | |
| 6,186,236 | B1 | 2/2001 | Cox | |
| 6,216,785 | B1 | 4/2001 | Achee, Jr. et al. | |
| 6,253,861 | B1 | 7/2001 | Carmichael et al. | |
| 6,431,291 | B1 | 8/2002 | Moore et al. | |
| 6,571,875 | B2 | 6/2003 | Bissonnette et al. | |
| 6,973,978 | B2 | 12/2005 | Cravatte | |
| 7,011,153 | B2 | 3/2006 | Erkol | |

(Continued)

FOREIGN PATENT DOCUMENTS

| | | |
|---|---|---|
| EP | 0207785 A2 | 1/1987 |
| WO | WO/0188328 A1 | 11/2001 |

OTHER PUBLICATIONS

B. Bloys, et al., Trapped Annular Pressure—A Spacer Fluid That Shrinks, Feb. 20, 2007, pp. 1-10, SPE/IADC 104698, SPE/IADC Drilling Conference, SPE, U.S.A.

Single-Action Bypass Sub brochure, 2007, p. 1, Mi Swaco, U.S.A.

(Continued)

*Primary Examiner* — Brad Harcourt
(74) *Attorney, Agent, or Firm* — Greenberg Traurig, LLP

(57) ABSTRACT

Valves comprise a chamber having a piston disposed therein. One side of the piston defines a hydrostatic chamber in fluid communication with an outside environment, such as wellbore annulus, through a port. Operatively associated with the piston on the other side is a sleeve in sliding engagement with an inner mandrel. The inner mandrel comprises a port that is initially blocked by the sleeve. Upon an increase in pressure within the annulus, the piston is moved causing the port in the sleeve to align with the port in the inner mandrel thereby allowing fluid to flow from the annulus into the bore of the inner mandrel. As a result, fluid can be circulated through the valve, or pressure within the annulus can be reduced. A return member is operatively associated with the piston to urge the piston toward the closed position after pressure within the wellbore annulus is reduced.

11 Claims, 5 Drawing Sheets

(56) References Cited

U.S. PATENT DOCUMENTS

| | | | | |
|---|---|---|---|---|
| 7,066,264 | B2 | 6/2006 | Bissonnette et al. | |
| 7,108,015 | B2 | 9/2006 | Lombari et al. | |
| 7,147,052 | B2 | 12/2006 | Erkol | |
| 7,353,845 | B2 | 4/2008 | Underwood et al. | |
| 7,500,526 | B2 | 3/2009 | Telfer | |
| 7,503,384 | B2 | 3/2009 | Coronado | |
| 7,628,213 | B2 | 12/2009 | Telfer | |
| 7,661,478 | B2 | 2/2010 | Palmer et al. | |
| 7,665,545 | B2 | 2/2010 | Telfer | |
| 7,762,324 | B2 | 7/2010 | Clem | |
| 7,861,744 | B2 | 1/2011 | Fly et al. | |
| 8,066,074 | B2 | 11/2011 | Maskos et al. | |
| 8,297,358 | B2 * | 10/2012 | Korkmaz et al. | 166/308.1 |
| 2003/0141059 | A1 | 7/2003 | Mauldin et al. | |
| 2004/0035591 | A1 * | 2/2004 | Echols | 166/386 |
| 2004/0094304 | A1 | 5/2004 | Turner et al. | |
| 2004/0159447 | A1 | 8/2004 | Bissonnette et al. | |
| 2005/0279501 | A1 | 12/2005 | Surjaatmadja et al. | |
| 2006/0191685 | A1 | 8/2006 | Coronado | |
| 2007/0012458 | A1 | 1/2007 | Jackson | |
| 2007/0240883 | A1 | 10/2007 | Telfer | |
| 2008/0093080 | A1 | 4/2008 | Palmer et al. | |
| 2009/0056952 | A1 | 3/2009 | Churchhill | |
| 2009/0139718 | A1 | 6/2009 | Clem | |
| 2009/0139720 | A1 | 6/2009 | Frazier | |
| 2010/0032162 | A1 | 2/2010 | Olstad et al. | |
| 2010/0181080 | A1 | 7/2010 | Levy | |
| 2010/0270030 | A1 | 10/2010 | Ashy et al. | |
| 2010/0319927 | A1 | 12/2010 | Yokley et al. | |
| 2010/0326737 | A1 | 12/2010 | Peddle et al. | |
| 2011/0030969 | A1 * | 2/2011 | Richards | 166/373 |
| 2012/0090852 | A1 | 4/2012 | Orr et al. | |
| 2012/0111574 | A1 * | 5/2012 | Desranleau et al. | 166/373 |

OTHER PUBLICATIONS

Single-Action Bypass Sub Jetting Tool brochure, 2007, p. 1, Mi Swaco, U.S.A.

B. Bloys, et al., Trapped Annular Pressure Migration: A Spacer Fluid that Shrinks—(Updated), Mar. 4, 2008, pp. 1-15, IADC/SPE 112872, IADC/SPE Drilling Conference, IADC/SPE, U.S.A.

Dennis Denney, Pipe-Rotation Effect on Hole Cleaning for Water-Based Drilling Fluids in Horizontal and Deviated Wells, Journal of Petroleum Technology, Nov. 2008, pp. 65-66, 68; Society of Petroleum Engineers; USA.

E. Paul Bercegeay, A One-Trip Gravel Packing System, Feb. 7, 1974, pp. 1-12, SPE 4771, American Institute of Mining, Metallurgical, and Petroleum Engineers, Inc., U.S.A.

E. Harold Vickery, Application of One-Trip Multi-Zone Gravel Pack to Maximize Completion Efficiency, Oct. 12, 2000, pp. 1-10, SPE 64469, Society of Petroleum Engineers Inc., U.S.A.

Stephen P. Mathis, Sand Management: A Review of Approaches and Concerns, May 13, 2003, pp. 1-7, SPE 82240, Society of Petroleum Engineers Inc., U.S.A.

Henry Restarick, Horizontal Completion Options in Reservoirs With Sand Problems, Mar. 11, 1995, pp. 545-560, SPE 29831, Society of Petroleum Engineers, Inc., U.S.A.

Nicholas J. Clem, et al., Utilizing Computational Fluid Dynamics (CFD) Analysis as a Design Tool in Frac Packing Application to Improve Erosion Life, SPE Annual Technical Conference and Exhibition, Sep. 24-27, 2006, SPE 102209, Society of Petroleum Engineers, San Antonio, Texas, USA.

Notification of Transmittal of the International Search Report and the Written Opinion of the International Searching Authority, or the Declaration, May 7, 2012, pp. 1-2, PCT/US2012/028398, Korean Intellectual Property Office.

International Search Report, May 7, 2012, pp. 1-4, PCT/US2012/028398, Korean Intellectual Property Office.

Written Opinion of the International Searching Authority, May 7, 2012, pp. 1-4, PCT/US2012/028398, Korean Intellectual Property Office.

* cited by examiner

ANNULAR CIRCULATION VALVE AND METHODS OF USING SAME

BACKGROUND

1. Field of Invention

The invention is directed to valves for compensating for pressure changes within an annulus of an oil or gas wellbore.

2. Description of Art

Valves can be used in oil and gas well completions to facilitate displacement of drilling fluids, such as drilling mud, out of the well by pumping completion fluids down the wellbore. In general, these valves allow the completion fluid to be pumped down the wellbore causing the drilling fluid within the wellbore annulus to flow into the valve and, thus, a tubular string containing the valve, and then upward within the tubular string to the surface of the well.

Wellbore barriers such as packers, bridge plugs and the like are used to seal or isolate zones or areas of an annulus of wellbores. In general, the wellbore barriers are disposed within a wellbore above and below a "zone" or area of the wellbore in which production, or other wellbore intervention operations are performed. In some instances, the isolated zone is not being produced or intervention operations are not being performed, however, tubing, e.g., an inner casing, is disposed through this zone so that oil or gas production or other downhole operations can be performed below the isolated zone. In these instances, the fluid trapped or sealed in this isolated zone can expand do to increases in the temperature of the fluid trapped in the isolated zone. When the temperature increases, such as during production from other zones within in the wellbore, the fluid expands and can cause damage to the inner casing of the wellbore, the outer casing of the wellbore, other components within the wellbore, or the formation itself. To reduce the likelihood of such damage, devices to relieve the pressure in the isolated zone are employed.

SUMMARY OF INVENTION

The valves disclosed herein facilitate one or both of circulation of drilling and completion fluids within an annulus of a wellbore and relief of the increased pressure within an isolated wellbore annulus. Broadly, the valves disclosed herein comprise an outer mandrel comprising an inner wall surface defining an outer mandrel bore, an outer wall surface, and an outer mandrel port disposed in the outer wall surface of the outer mandrel and in fluid communication with the outer mandrel bore. An inner mandrel disposed is within the outer mandrel bore. The inner mandrel comprises an inner wall surface defining an inner mandrel bore, an outer wall surface, and an inner mandrel port disposed in the outer wall surface of the inner mandrel and in fluid communication with the inner mandrel bore. The outer mandrel is fixed to the inner mandrel at a first end thereby providing an annulus between the outer wall surface of the inner mandrel and the inner wall surface of the outer mandrel. A sleeve, which comprises a sleeve port, is disposed within the annulus and in sliding engagement with the inner wall surface of the outer mandrel and the outer wall surface of the inner mandrel. The sleeve moves within the annulus due to an increase in pressure within an isolated outside environment until the sleeve port is at least partially aligned with the port of the inner mandrel. Fluid such as drilling and completion fluids can be circulated between the wellbore annulus and the inner mandrel bore during completion operations. Moreover, after one or more barriers, such as packers, are set to provide an isolated wellbore annulus, fluid can be transferred between the isolated wellbore annulus and the inner mandrel bore so that the valve functions as a pressure relief device.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1A:
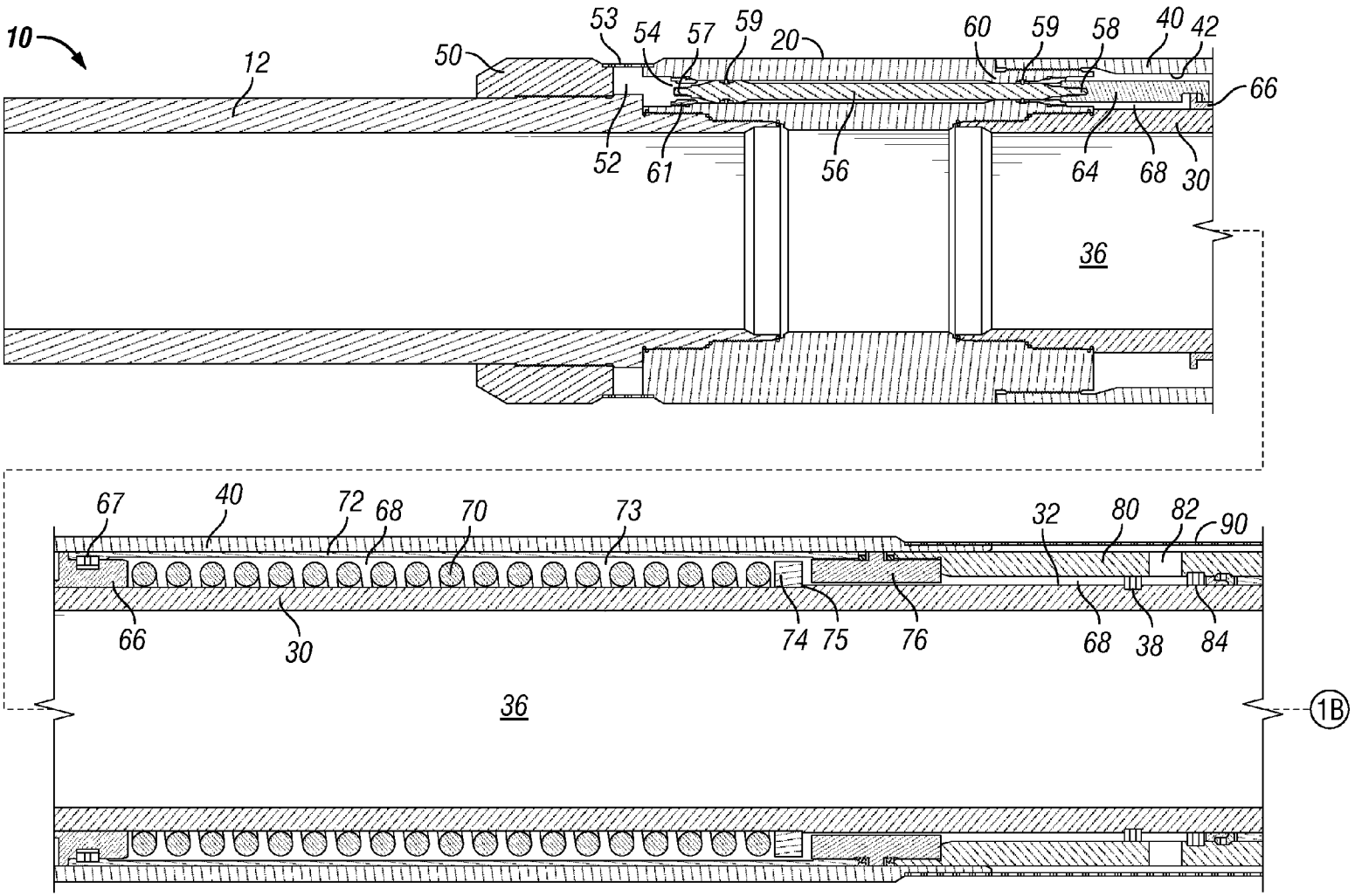
FIGS. 1A and 1B comprise a cross-sectional view of one specific embodiment of a valve disclosed herein shown in the closed position.
Figure 1B:
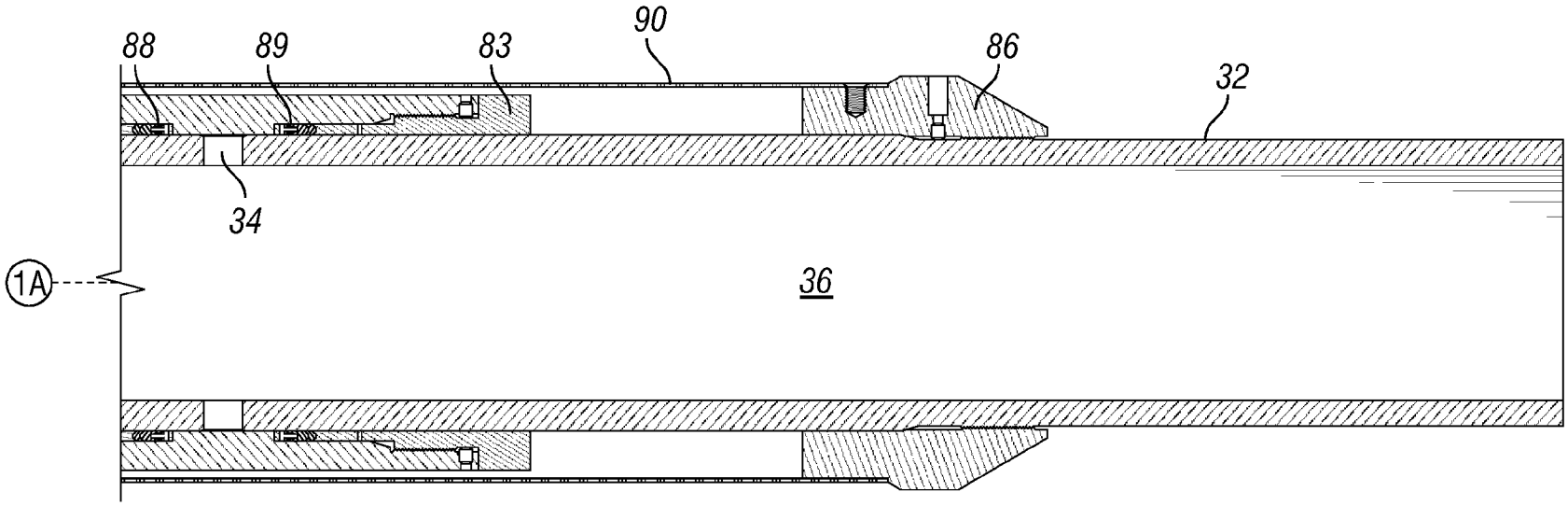
Figure 2A:
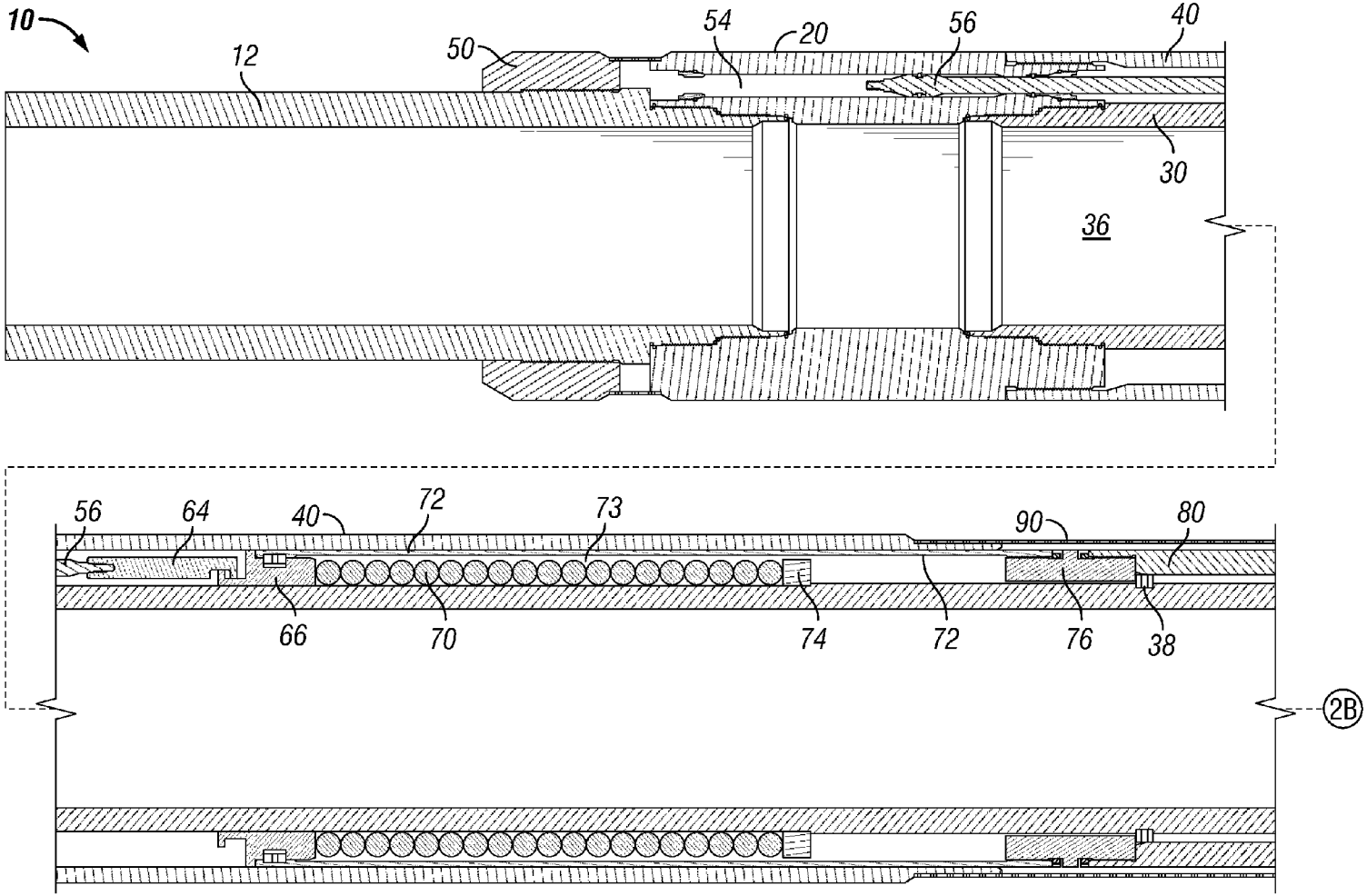
FIGS. 2A and 2B comprise a cross-sectional view of the valve of FIG. 1 shown in the opened position.
Figure 2B:
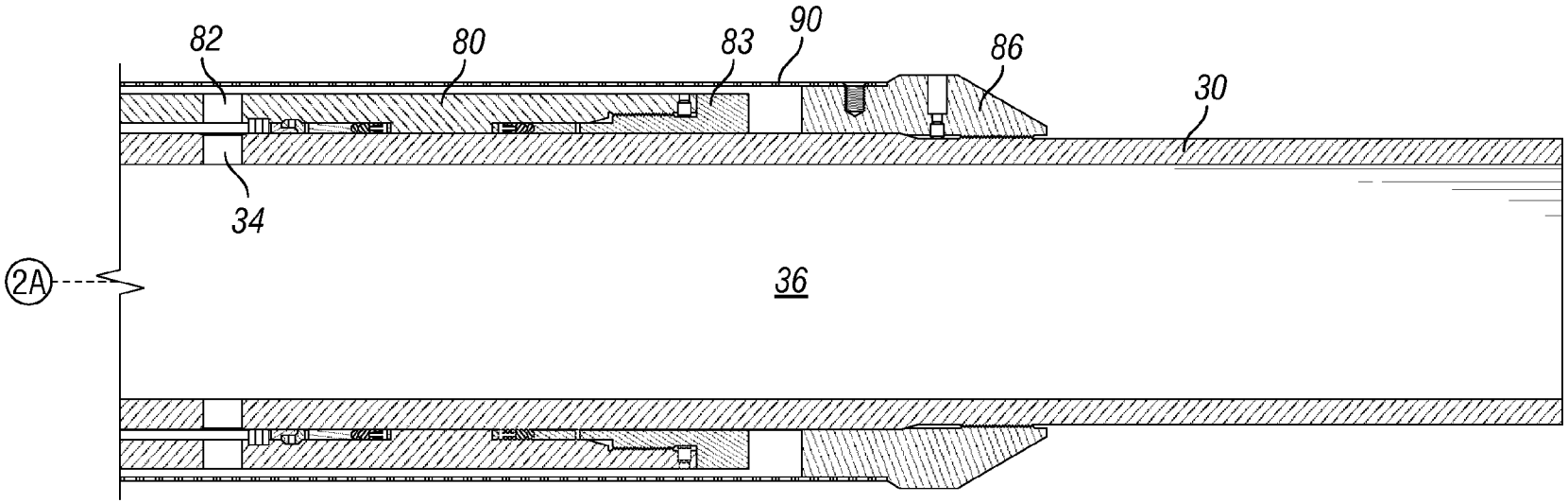
Figure 3:
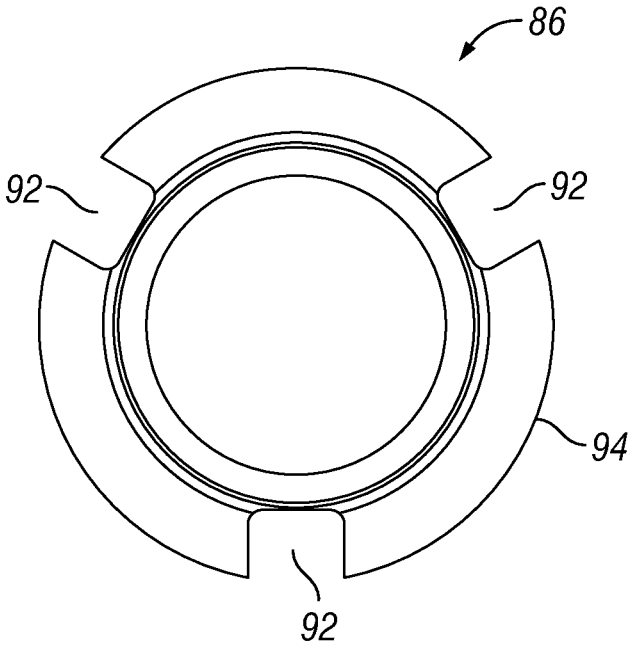
FIG. 3 is a cross-sectional view of the valve of FIGS. 1A and 1B taken along line 3-3 (shown in FIG. 1B).

Referring now to FIGS. 1-3, in one specific embodiment, valve 10 is shown. Broadly, this embodiment of valve 10 comprises top sub 12 connected to piston housing 20 which is connected to inner mandrel 30 and outer mandrel 40. Top sub 12 is connected to piston housing 20, and piston housing 20 is connected to inner mandrel 30 and outer mandrel 40, through any method or device known in the art such as through threads (not shown). Gage ring 50 provides port 52 in fluid communication with piston chamber 54 so that fluid flowing from outside valve 10 through port 52 and into piston chamber 54 causes piston 56 to move downward (i.e., toward the right in the Figures). Screen 53 is disposed over port 52 to restrict debris from entering port 52 and causing interference with the movement of piston 56.

Piston 56 comprises upper end 57, lower end 58, and piston seals 59. Although piston 56 may comprise a circular, concentrically-disposed, sleeve-type piston, in the embodiment shown in the Figures, piston 56 comprises a partial sleeve. Downward movement, i.e., to the right in the Figures, of piston 56 is restricted by piston stop 60 shown as a restriction of the inner diameter of piston chamber 54. Similarly, upward movement, i.e., to the left in the Figures, of piston 56 is restricted by piston stop 61 shown as a separate component disposed on the wall of piston chamber 54.

Piston mandrel 64 facilitates connection between piston 56 and upper coupling 66.

Disposed between outer wall surface 32 of inner mandrel 30 and inner wall surface 42 of outer mandrel 40 is annulus 68. Disposed in annulus 68 is piston mandrel 64 secured to upper coupling 66, which is operatively associated with a return member, shown in the embodiments of the Figures as including spring 70. Spring 70 is disposed within sleeve 72. Spring stop or detent 74 provides a surface for compression of spring 70. Detent 74 is maintained against outer wall surface 32 of inner mandrel 30, but is not secured to sleeve 72 or outer mandrel 40. In one embodiment, detent 74 is maintained against outer wall surface 32 by the force generated by spring 70 pushing detent 74 into shoulder 75. Attachment member 67, shown as a c-ring, is also operatively associated with upper coupling 66 to secure upper coupling 66 to sleeve 72.

In addition to spring 70, return member can also comprise atmospheric chamber 73. As a result, as upper coupling 66 moves downward, pressure within atmospheric chamber 73 becomes compressed or energized (FIG. 2) such that as the pressure below piston dissipates, the energized atmospheric chamber 73 urges piston 56 upward toward port 52, i.e., toward the "run-in" position or closed position (FIG. 1).

In addition to being connected to upper coupling 66 at an upper end by attachment member 67, sleeve 72 is connected at a lower end to lower coupling 76. As shown in the specific embodiment of FIGS. 1-3, upper coupling 66 is in a sliding engagement with outer wall surface 32 of inner mandrel 30; however, upper coupling 66 is not required to be in contact with outer wall surface 32. Similarly, in the specific embodiment of FIGS. 1-3, lower coupling 76 is shown as not being in sliding engagement with outer wall surface 32 of inner mandrel; however, lower coupling 76 can be placed in sliding engagement with outer wall surface 32. The connection of sleeve 72 to both upper and lower couplings 66, 76 causes movement of lower coupling 76 when piston 56 moves downward (i.e., to the right in the Figures).

Ported housing 80 is connected to lower coupling 76. Ported housing 80 includes port 82 and is maintained within annulus 68 by a threaded connection to lower coupling 76. The force of return member, i.e., spring 70 in the embodiment shown in the Figures, acting against detent 74 and upper coupling 66 maintains ported housing 80 in the closed position (FIGS. 1A-1B).

Ported housing 80 can be a separate component as shown in the Figures or can be a continuation of sleeve 72, i.e., formed as an integral component combining sleeve 72 and ported housing 80. In addition, as shown in the embodiment of the Figures, retainer 83 can be disposed at a lower end of ported housing 80 to facilitate sealing engagement of ported housing 80 with outer wall surface 32 of inner mandrel 30.

Retainer member 84, shown as a c-ring, is in sliding engagement with outer wall surface 32 of inner mandrel 30. Retainer member 84 facilitates maintaining seals 88, 89 in place. Seals 88, 89 reduce fluid leakage between ported housing 80 and inner mandrel 30.

Lower guide 86 is secured to outer wall surface 32 of inner mandrel 30. As shown in FIG. 3, lower guide 86 has three grooves or slots 92 milled along outer wall surface 94 of lower guide 86. Slots 92 reduce the likelihood that sediment or other debris will collect in the void below ported housing 80 hindering the operation valve 10. As shown in FIG. 3, slots 92 are milled longitudinally, however, slots 92 can be milled in any arrangement that permits fluid and debris to flow past lower guide 86. For example, slots 92 can comprise one or more spiral-shaped slots.

Screen 90 is secured to lower guide 86 and outer mandrel 40 to restrict debris from entering ports 82 and 34 when valve 10 is in the opened position (FIG. 2) which could cause restriction of fluid flow from outside of valve 10 into bore 36 of inner mandrel 30.

Snap ring 38 secured to outer wall surface 32 of inner mandrel 30 acts as a detent or stop to prevent lower coupling 76 and, thus, ported housing 80 from traveling along outer wall surface 32 of inner mandrel 30 past a certain point. The point at which lower coupling 76 is stopped by snap ring 38 is the point at which port 82 is aligned with port 34, i.e., when valve 10 is in its opened position (FIG. 2).

In one specific operation of valve 10, valve 10 is placed in a work string such as production string or other string of tubing (not shown in FIG. 1) and run-into a cased wellbore (not shown in FIG. 1). A lower packer or other wellbore barrier is set below valve 10. Completion fluid is then pumped down the wellbore annulus. As the pressure in the wellbore annulus increases due to the completion fluid being pumped into the wellbore annulus, the increased pressure enters piston chamber 54 and exerts a force on piston 56. Piston 56 is then moved away from port 52 causing the upper coupling 66 to move downward which, in turn, causes sleeve 72 and ported housing 80 to also move downward until port 82 is at least partially aligned with port 34. Upon partial alignment of port 82 with port 34, the fluid pressure within the wellbore annulus is allowed to flow into bore 36, thereby permitting drilling fluid that was previously disposed within the wellbore annulus to flow into the tubular string to be carried to the surface of the wellbore. As a result, the drilling fluid previously disposed in the wellbore is replaced with completion fluid.

During movement of piston 56, the return member, e.g., spring 70 and/or atmospheric chamber 73, become compressed or "energized." Therefore, if the pressure within the wellbore annulus decreases, such as due to completion fluid no longer being pumped down the wellbore annulus, the compressed spring 70 and/or atmospheric pressure within atmospheric chamber 73 exerts a force against piston 56 that is greater than the hydrostatic pressure within piston chamber 54. Accordingly, the return member forces piston 56 to move toward port 52 to return it to its "run-in" position causing valve 10 to return to its closed position. Thereafter, piston 56 is in position such that it can again move away from port 52 in response to a pressure increase within the wellbore annulus.

Thereafter, a barrier such as a packer, can be set above valve 10 to provide an isolated wellbore annulus. The isolation of the wellbore annulus also can be established by any other method or device known in the art such as by use of one or more wellbore barriers such as bridge plugs, valves, wellheads, the bottom of the wellbore, and the like. Thereafter, in the event that the fluid contained within the isolated wellbore annulus expands, or the pressure within the isolated wellbore annulus increases, such as due to production operations being performed through the work string, the increased pressure enters piston chamber 54 and exerts a force on piston 56. Piston 56 is then moved away from port 52 causing the upper coupling 66 to move downward which, in turn, causes sleeve 72 and ported housing 80 to also move downward until port 82 is at least partially aligned with port 34. Upon partial alignment of port 82 with port 34, the fluid pressure within the wellbore annulus is allowed to flow into bore 36, thereby relieving pressure within the wellbore annulus. As a result, the pressure being exerted on the inner wall of the casing, or the inner wall of the formation, or the outer wall surface of the work string, is spread out and lessened, which decreases the likelihood of failure of any of the casing, the formation, or the work string, or any other wellbore component disposed in the isolated wellbore annulus.

During movement of piston 56, the return member, e.g., spring 70 and/or atmospheric chamber 73, become compressed or "energized." Therefore, if the pressure within the isolated wellbore annulus decreases, such as due to a temperature decrease due to cessation of production operations through the work string or due to sufficient pressure being relieved from the wellbore annulus through port 82 and port 34, the compressed spring 70 and/or atmospheric pressure within atmospheric chamber 73 exerts a force against piston 56 that is greater than the hydrostatic pressure within piston chamber 54. Accordingly, the return member forces piston 56 to move toward port 52 to return it to its "run-in" position causing valve 10 to return to its closed position. Thereafter, piston 56 is in position such that it can again move away from port 52 in response to a pressure increase within the isolated wellbore annulus.

It is to be understood that the invention is not limited to the exact details of construction, operation, exact materials, or embodiments shown and described, as modifications and equivalents will be apparent to one skilled in the art. For example, the piston may comprise a full sleeve instead of the partial sleeve shown in the Figures. Moreover, the return member may comprise belleville springs or any other type of return member. Further, although one piston is shown in the embodiment of the Figures, two or more pistons may be used. Accordingly, the invention is therefore to be limited only by the scope of the appended claims.

What is claimed is:

1. A valve comprising:

an inner mandrel, a piston housing, a top sub, a gage ring, an outer housing, a lower screen, and a guide, wherein the inner mandrel is secured to the piston housing and the piston housing is secured to the top sub to provide a string bore disposed through the inner mandrel, the piston housing and the top sub, and the outer housing is secured to the piston housing to provide an annulus between an inner wall surface of the outer housing and an outer wall surface of the inner mandrel, wherein the gage ring is secured to a lower end of the top sub to provide a piston port in fluid communication with a piston housing bore and an environment disposed outside of the outer housing, the piston housing bore having a piston disposed therein, wherein the piston is operatively associated with a sleeve, the sleeve being in sliding engagement with the outer wall surface of the inner mandrel, the sleeve comprising a sleeve port, wherein a lower end of the outer housing is secured to an upper end of a first screen and a lower end of the first screen is secured to the guide, the guide being fixed to the outer wall surface of the inner mandrel.

2. The valve of claim 1, wherein the piston is operatively associated with the sleeve through an upper coupling and a lower coupling, the upper coupling and lower coupling being fixed to each other through a return member housing, the return member housing having a return member disposed therein.

3. The valve of claim 2, wherein the return member comprises a spring operatively associated with the upper coupling and a detent disposed on the outer wall surface of the inner mandrel.

4. The valve of claim 3, wherein the upper coupling is connected to a piston mandrel and the piston mandrel is connected to the piston.

5. The valve of claim 1, wherein the piston housing comprises upper and lower piston stops to restrict the movement of the piston within the piston housing.

6. The valve of claim 1, wherein the guide comprises at least one groove disposed in an outer wall surface of the guide.

7. The valve of claim 6, wherein the guide comprises three grooves disposed longitudinally in the outer wall surface of the guide.

8. A method of circulating fluid between a wellbore annulus and a valve, the method comprising the steps of:

(a) providing a wellbore having a wellbore annulus;

(b) disposing a valve within the wellbore, the valve comprising an outer mandrel comprising an inner wall surface defining an outer mandrel bore, an outer wall surface, and an outer mandrel port disposed in the outer wall surface of the outer mandrel and in fluid communication with the outer mandrel bore, an inner mandrel disposed within the outer mandrel bore, the inner mandrel comprising an inner wall surface defining an inner mandrel bore, an outer wall surface, and an inner mandrel port disposed in the outer wall surface of the inner mandrel and in fluid communication with the inner mandrel bore, the outer mandrel being fixed to the inner mandrel at a first end thereby providing an annulus between the outer wall surface of the inner mandrel and the inner wall surface of the outer mandrel, and a sleeve disposed within the annulus and in sliding engagement with the inner wall surface of the outer mandrel and the outer wall surface of the inner mandrel, the sleeve comprising a sleeve port, wherein the sleeve moves within the annulus due to an increase in pressure within the wellbore annulus until the sleeve port is at least partially aligned with the port of the inner mandrel, and wherein the outer mandrel port is in fluid communication with the wellbore annulus; and (c) moving the sleeve away from the outer mandrel port due to an increase in pressure within the wellbore annulus causing the sleeve port to at least partially align with the inner mandrel port, thereby permitting fluid to flow from the wellbore annulus into the inner mandrel bore.

9. The method of claim 8, wherein during step (c), a completion fluid is pumped down the wellbore annulus and a drilling fluid flows from the wellbore annulus into the inner mandrel bore to replace at least a portion of the drilling fluid in the wellbore annulus with at least a portion of the completion fluid.

10. The method of claim 9, further comprising the steps of:

(d) reducing the pressure of the completion fluid being pumped down the wellbore annulus causing the sleeve to move toward the outer mandrel port causing the sleeve port to move out of alignment with the inner mandrel port;

(e) setting a first wellbore barrier above the valve to provide an isolated wellbore annulus disposed below the first wellbore barrier; and (f) moving the sleeve away from the outer mandrel port due to an increase in completion fluid pressure within the isolated wellbore annulus causing the sleeve port to at least partially align with the inner mandrel port, thereby permitting at least a portion of the completion fluid to flow from the isolated wellbore annulus into the inner mandrel bore causing a reduction in pressure within the isolated wellbore annulus.

11. The method of claim 10, further comprising the step of:

(g) after sufficient pressure has been reduced within the isolated wellbore annulus, moving the sleeve toward the outer mandrel port causing the sleeve port to move out of alignment with the inner mandrel port.

* * * * *